US006419277B1

(12) United States Patent
Reynolds

(10) Patent No.: US 6,419,277 B1
(45) Date of Patent: Jul. 16, 2002

(54) CONDUIT SECTION HAVING THREADED SECTION CONNECTORS AND EXTERNAL CONDUITS ATTACHED THERETO

(75) Inventor: Graeme Reynolds, Houston, TX (US)

(73) Assignee: Hydril Company, Houston, TX (US)

( * ) Notice: Subject to any disclaimer, the term of this patent is extended or adjusted under 35 U.S.C. 154(b) by 0 days.

(21) Appl. No.: 09/698,519

(22) Filed: Oct. 27, 2000

Related U.S. Application Data

(60) Provisional application No. 60/162,382, filed on Oct. 29, 1999.

(51) Int. Cl.[7] ..... F16L 19/00

(52) U.S. Cl. ..... 285/123.1; 285/124.1; 285/124.3; 166/367

(58) Field of Search ..... 285/121.3, 123.1, 285/124.1, 124.2, 124.3, 124.4, 124.5, FOR 118, 333; 166/367, 359; 405/224.2, 224.3, 224.4

(56) References Cited

U.S. PATENT DOCUMENTS

| | | | | | |
|---|---|---|---|---|---|
| 3,858,401 | A | * | 1/1975 | Watkins | 166/367 |
| 4,330,140 | A | * | 5/1982 | Hampton | 285/39 |
| 4,487,433 | A | * | 12/1984 | Miller | 285/81 |
| 4,496,173 | A | | 1/1985 | Roche et al. | 285/24 |
| 4,646,840 | A | * | 3/1987 | Bartholomew et al. | 166/367 |
| 4,662,785 | A | * | 5/1987 | Gibb et al. | 166/359 |
| 4,808,035 | A | * | 2/1989 | Stanton et al. | 166/355 |
| 4,911,243 | A | * | 3/1990 | Beynet | 166/359 |
| 5,423,575 | A | * | 6/1995 | Parks | 166/367 |
| 5,657,823 | A | * | 8/1997 | Kogure et al. | 166/340 |
| 6,004,074 | A | * | 12/1999 | Shanks, II | 166/367 |

OTHER PUBLICATIONS

"Series 500 Type 533 Tubing Connection, For Production Tubing and Workstring Applications" Bulletin 9403–C; Hydril Company, Undated.

"Series 500 Type 521 Casing Connection, An Excellent Choice for Horizontal Wells and Large Diameter Surface Casing" Bulletin 9001–C; Hydril Company, Undated.

"Series 500 Type 563 Casing Connection, For Structurally Demanding Production Casing and Thermal Applications" Bulletin 9101–C; Hydril Company, Undated.

"Series 500 Type 513 & Type 523 Integral Casing Connections, Combining the Benefits of a Metal Seal with the Superior Compression and Torque Capabilities of the Wedge Thread" Bulletin 9902–A; Hydril Company, Undated.

"Series 500 Type 553 Tubing Connection, Combining the Benefits of an Integral Connection with the Reduced Cost of One–End Upset (OEU) Pipe" Bulletin 9901–A; Hydril Company, Undated.

"Series 500 Type 563 Tubing Connection, For Production Tubing and Workstring Applications" Bulletin 9401–B; Hydril Company, Undated.

"Series 500 Type 503 Tubing Connection, Combining the Benefits of an Integral Connection with the Reduced Cost of API Upset Pipe" Bulletin 0001; Hydril Company, Undated.

"Series 500 Type 501, Type 531 and Type 561 Tubing Connections, For Production Tubing and Workstring Applications" Bulletin 9502–A; Hydril Company, Undated.

"Series 500 Type 511 Casing Connection, For Surface Casing, Drilling and Horizontal Liners, and Wash Pipe Application" Bulletin 9501–B; Hydril Company, Undated.

* cited by examiner

*Primary Examiner*—Jack Lavinder
*Assistant Examiner*—James M. Hewitt
(74) *Attorney, Agent, or Firm*—Rosenthal & Osha L.L.P.

(57) ABSTRACT

A marine riser segment which includes a riser joint having a threaded coupling at each end and flanges disposed on an exterior of the joint. Each of the flanges is coupled to the joint by a bearing. The flanges including openings therein for auxiliary conduits, so that the conduit joint is connectible to another such joint by relative rotation of corresponding ones of the threaded couplings, while the flanges remain rotationally fixed.

9 Claims, 2 Drawing Sheets

36
34
12
20
12
20
38
24
24
12
20
24
24
21
12
20
24
24
12
20
24
24
12
20
24
32
30

CONDUIT SECTION HAVING THREADED SECTION CONNECTORS AND EXTERNAL CONDUITS ATTACHED THERETO

CROSS-REFERENCE TO RELATED APPLICATIONS

This application claims priority from U.S. Provisional Application Ser. No. 60/162,382 filed on Oct. 29, 1999.

FIELD OF THE INVENTION

The invention is related generally to the field of conduits used as marine drilling riser. More specifically, the invention is related to methods and apparatus for joining together sections of such riser where the riser includes external conduits.

BACKGROUND OF THE INVENTION

Marine drilling riser is a conduit which extends generally from a valve system (called a "blowout preventer" or "BOP" stack) disposed on the sea floor up to equipment, typically a drilling rig, disposed on a floating drilling vessel. The riser is used to return drilling fluid ("mud") and drill cuttings from a wellbore drilled through earth formations below the sea floor. Marine drilling riser typically includes a number of auxiliary conduits positioned generally externally to the main pipe or conduit. As is known in the art, the auxiliary conduits, including a choke/kill line, a mud boost line and hydraulic lines, provide communication from the drilling rig to the wellbore through the BOP stack, provide communication to the drilling riser through a riser adapter, and supply hydraulic power to control pods which operate the various control functions on the BOP stack.

Assembling a marine riser, particularly when the auxiliary conduits are used, can be time consuming and expensive. The difficulty in such assembly is a result of the need to keep the auxiliary conduits rotationally fixed. Various connection devices have been developed to increase the speed and efficiency of marine riser assembly where auxiliary conduits are used. For example, U.S. Pat. No. 4,496,173 issued to Roche et al. describes a threaded connector for segments of marine riser which enables the segments ("joints") of riser to remain rotationally fixed while providing. substantial and evenly distributed axial force to couple the riser joints. Still other connections include flanges which can be bolted together, as explained in the Roche et al. '173 patent.

Riser connection methods and apparatus known in the art, while effective in reducing the time and expense of riser assembly, require expensive and difficult machining to the riser joints and/or the coupling mechanisms themselves.

It is desirable to have a marine riser connection which enables using conventional threaded couplings between the riser joints while enabling auxiliary conduits to remain rotationally fixed.

SUMMARY OF THE INVENTION

The invention is a marine riser segment, which comprises a riser joint having a threaded coupling at each end and flanges disposed on an exterior of the joint. Each of the flanges is coupled to the joint by a bearing. The flanges including openings therein for auxiliary conduits, so that the conduit joint is connectible to another such conduit joint by relative rotation of corresponding ones of the threaded couplings, while the flanges remain rotationally fixed.

Other aspects and advantages of the invention will be apparent from the following description and the appended claims.

DETAILED DESCRIPTION OF THE INVENTION

Figure 1:
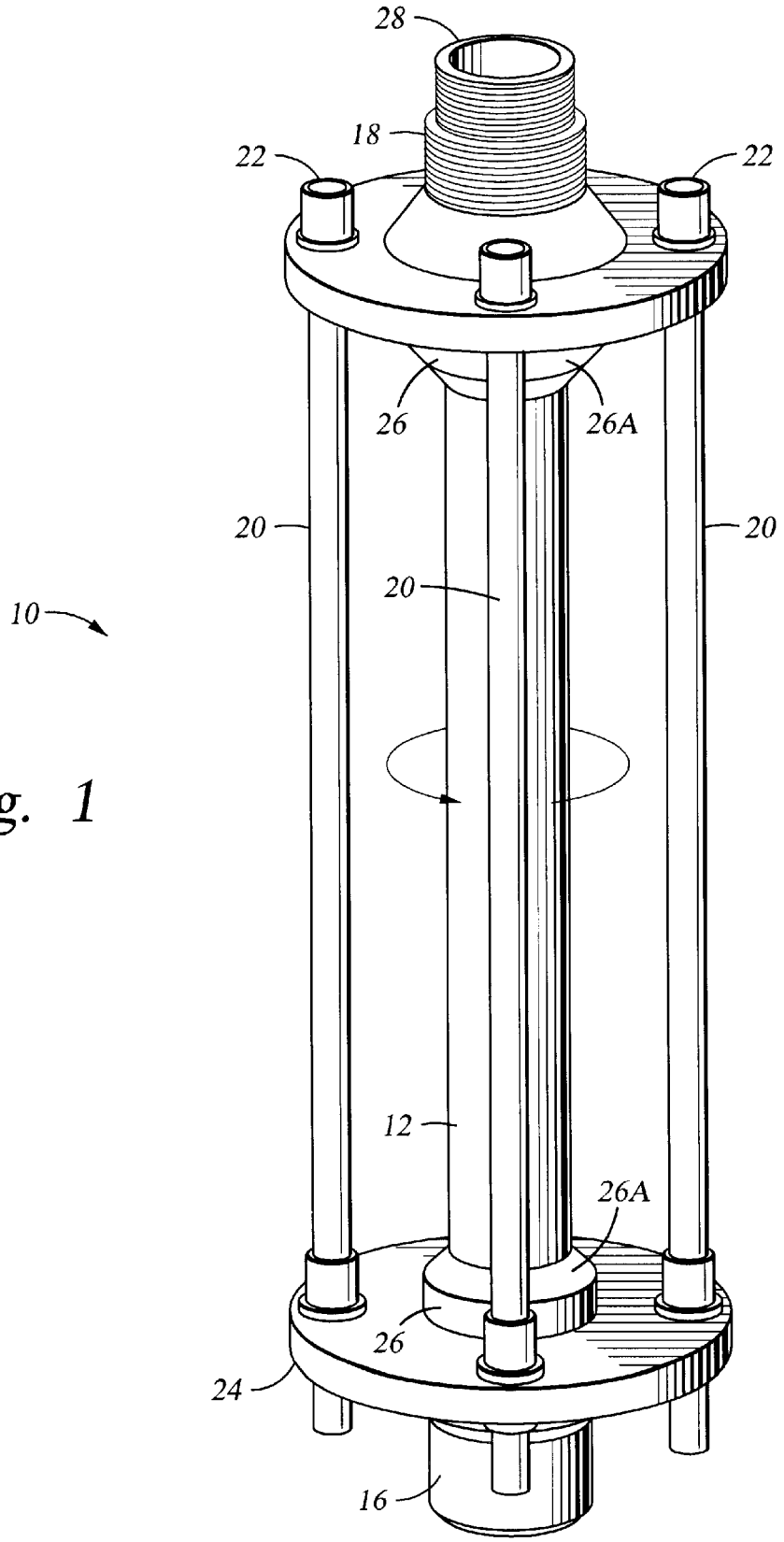
FIG. 1 shows one example of a segment of riser or conduit including conventional threaded couplings and rotationally fixed auxiliary conduits.

FIG. 1 shows one example of a section ("joint") of riser pipe or conduit which can be assembled to other joints of such conduit by threaded couplings, while having rotationally fixed auxiliary conduits attached to the exterior of the joint. The conduit joint is shown generally at 10 and includes a pipe segment or pipe joint 12 having a selected length. The length of the joint 12 is not critical to the invention, but as is known to those skilled in the art of marine drilling riser systems, the joint 12 preferably is of a standard length for segments of marine riser, approximately seventy-five feet.

The joint 12 includes at its ends threaded couplings. The threaded couplings in the example shown in FIG. 1 include a male or "pin" end 18 and a female or "box" end 16. Typically each such joint 12 will include a pin at one end and a box at the other end, the box having threads adapted to mate with the pin threads on another like joint of conduit, but this thread configuration is not intended to limit the invention. It is within the contemplation of this invention that the joint 12 could include two pin ends, like joints being coupled by means of "collars" having the equivalent of two box ends, similar to the manner in which "casing" (conduit cemented into the wellbore itself) is typically assembled.

Like joints 12 in the embodiment shown in FIG. 1 are coupled together by inserting a pin 18 into a corresponding box 16 and rotating one joint with respect to the other joint until a preselected ("make up") torque is applied between the connected joints. When used as a marine riser, the joint 12 is typically positioned in a drilling rig (not shown) with the pin 18 pointing up ("pin up") as is conventional for assembly of marine riser. Pin up or "pin down" orientation during connection of joints to each other, however, is not meant to limit the invention.

The joint 12 has attached, to its exterior, flanges 24 which in this example have therein openings for auxiliary conduits 20. As is known in the art, the auxiliary conduits 20 typically include a "mud boost" line, a "choke/kill" line and hydraulic conduits, each auxiliary conduit 20 carrying any one of hydraulic power, drilling fluid and chemicals. The auxiliary conduits 20 on each joint 12 may be connected to the auxiliary conduits on another joint by any type of connectors known in the art. See, for example, U.S. Pat. No. 4,496,173 issued to Roche et al. for a description of such connectors.

The flanges 24 are coupled to the joint 12 by bearings 26, which can be ball, roller, or any other type that will enable relative rotation between the joint 12 and the flanges 24. In one example, the bearings 26 are coupled to the joint 12 by mounting pads 26A, which can be in the form of split shells affixable to the exterior of the joint 12 between the pin 18 and the box 16. Using the mounting pads 26A enables the bearings to be easily coupled to the exterior of the joint even where the pin 18 and the box 16 are of the "upset" type, meaning that the diameter of make up shoulders on the pin 18 and the box exceed the diameter of the joint 12 axially between the pin 18 and the box 16. Alternatively, the pin 18 can be the non-upset type, as described in a sales brochure entitled, "Series 500 Tubular Connections", Hydril Company, Houston, Tex. (1998). When the pin 18 is of the non-upset type, the bearings 26 can have an internal diameter substantially the same as the outer diameter of the joint away from the box 16. Still another embodiment includes bearings 26 having inside diameter substantially the same as the outside diameter of upset-type pins and boxes. The bearings in any such case can be press-fit, locked in position with snap rings or the like, or welded in place on the exterior of the joint 12. The axial position of the bearings 26 and flanges 24 is not meant to limit the invention; however in the case where mounting pads 26A are used, the bearings 26 and flanges 24 should be located axially inboard of the upset thread ends (pin 18 and box 16).

Because the flanges 24 are coupled to the joint 12 through the bearings 26, when the joint 12 is assembled to a corresponding joint, the joint 12 can be rotated while the flanges 24 and the auxiliary conduits 20 can remain rotationally fixed. This enables the joint 12 to be connectible to other such joints using conventional threaded coupling methods.

In the example shown in FIG. 1, the pin 18 includes therein an adapter 28 which enables the joint 12 to be rotated by the use of a "top drive" drilling rig, of types well known in the art.

Figure 2:
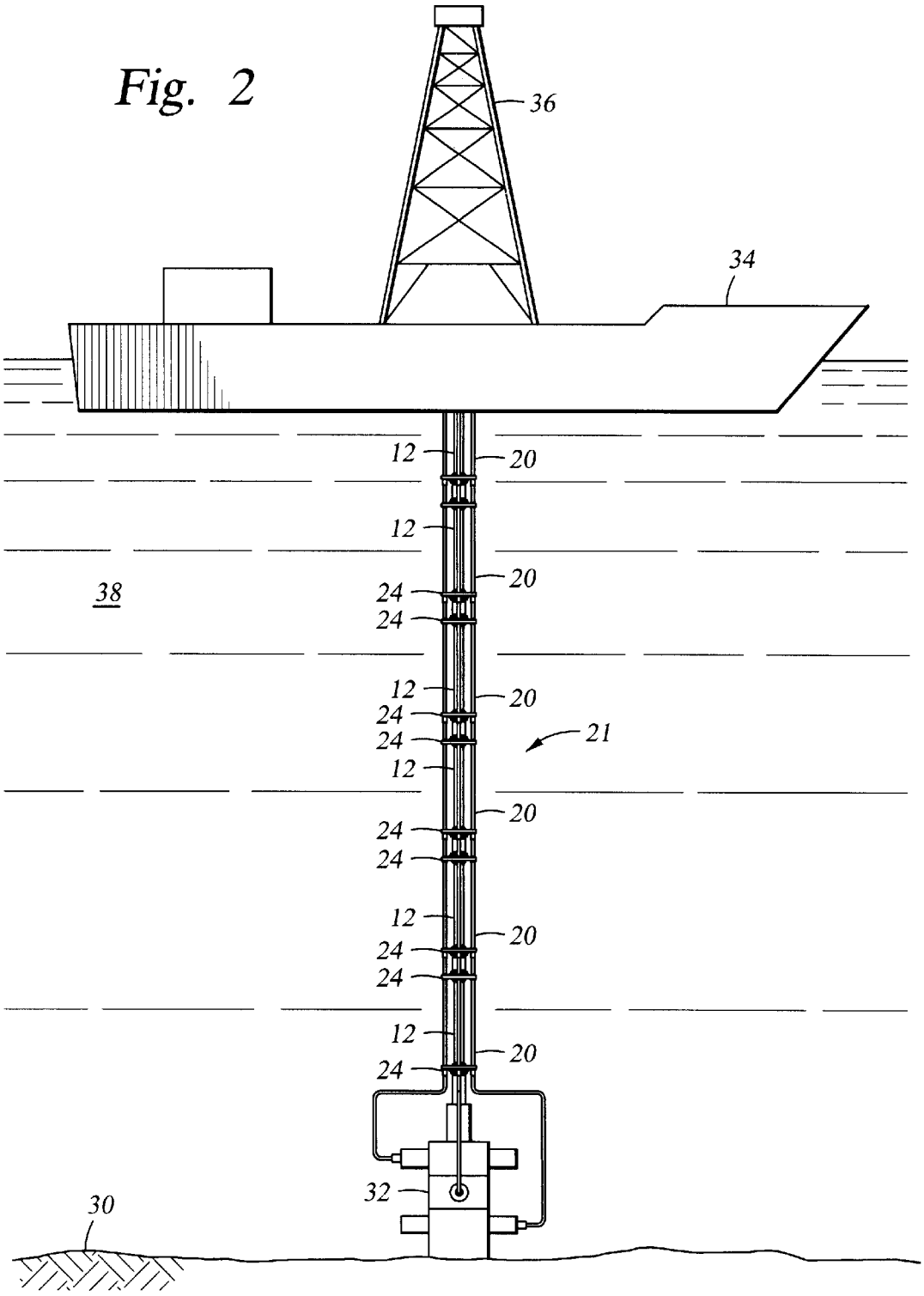
FIG. 2 shows an example of a marine riser assembled from riser segments as shown in FIG. 1.

FIG. 2 shows an example of a marine riser 21 assembled from a plurality of joints 12 of riser according to the invention. The riser 21 extends in this example from a floating drilling vessel 34 to a subsea BOP stack 32 on the floor 30 of the ocean 38. When assembled, the riser joints 12 enable passage of the external conduits 20 through flanges 24 from equipment (not shown) on the drilling vessel 34 to the BOP stack 32. When assembling the joints 12 to form the riser 21, the joints are coupled by rotation of the uppermost joint by rotation of equipment on a drilling rig 36 on the vessel 34 as is conventional for assembling drill pipe or casing. The auxiliary conduits typically will include at least one of an hydraulic line to operate the various components of the BOP stack 32, and a choke/kill line.

Those skilled in the art will appreciate that it is possible to devise other embodiments of this invention which do not depart from the spirit of the invention as disclosed herein. Accordingly, the scope of the invention shall be limited only by the attached claims.

What is claimed is:

1. A marine riser segment, comprising:

a riser joint, the joint having a threaded coupling at each end; and flanges disposed about an exterior of the joint, the flanges including openings therein for auxiliary conduits, each flange coupled to the joint by a bearing so that the joint is connectible to another such joint by relative rotation of corresponding ones of the threaded couplings while the flanges remain rotationally fixed.

2. The marine riser segment as defined in claim 1 wherein the threaded couplings are the upset type, and the bearings have an internal diameter large enough to pass over the threaded couplings, the bearings each coupled to the joint at an axial position between the threaded couplings by a mounting pad.

3. The marine riser segment as defined in claim 1 wherein the mounting pads comprise split shells.

4. The marine riser segment as defined in claim 1 wherein at least one of the threaded couplings comprises a non-upset type, and the bearings have an internal diameter substantially the same as an external diameter of the joint.

5. A marine riser, comprising:

a plurality of riser joints threadedly coupled to each other, each of the riser joints having a threaded coupling at each end and flanges disposed on an exterior of the joint, the flanges including openings therein for auxiliary conduits, each flange coupled to the joint by a bearing so that the joint is connectible to another such joint by relative rotation of corresponding ones of the threaded couplings while the flanges remain rotationally fixed, the riser joints extending from a drilling rig to a blowout preventer stack disposed on a sea floor; and auxiliary conduits passing through the flanges from the drilling rig substantially to the blowout preventer stack on the sea floor.

6. The marine riser as defined in claim 5 wherein the threaded couplings are the upset type, and the bearings have an internal diameter large enough to pass over the threaded couplings, the bearings each coupled to each of the joints at an axial position between the threaded couplings by a mounting pad.

7. The marine riser as defined in claim 5 wherein the mounting pads comprise split shells.

8. The marine riser segment as defined in claim 5 wherein at least one of the threaded couplings comprises a non-upset type, and the bearings have an internal diameter substantially the same as an external diameter of the joint.

9. The marine riser as defined in claim 5 wherein the auxiliary conduits comprise at least one of an hydraulic fluid line and a choke/kill line.

* * * * *